US005715909A

United States Patent [19]

Gagnon

[11] Patent Number: 5,715,909

[45] Date of Patent: Feb. 10, 1998

[54] STEPLADDER INCLUDING A BRACING SHELF

[76] Inventor: Gilles Gagnon, 4074, St-Alexandre, Jonquière, Québec, Canada, G8A 1M4

[21] Appl. No.: 559,635

[22] Filed: Nov. 20, 1995

[51] Int. Cl.[6] ..... E06C 7/14

[52] U.S. Cl. ..... 182/173; 182/176; 182/165; 182/104

[58] Field of Search ..... 182/165, 173, 182/175, 176, 180, 25, 104

[56] References Cited

U.S. PATENT DOCUMENTS

| | | | |
|---|---|---|---|
| 712,351 | 10/1902 | Adkins | 182/173 |
| 1,113,436 | 10/1914 | Hartzler | 182/176 |
| 1,992,391 | 2/1935 | Pease . | |
| 2,007,713 | 9/1935 | Gaffers | 182/176 |
| 2,481,581 | 9/1949 | Ehnhuus | 228/63 |
| 4,079,814 | 3/1978 | Larson | 182/176 |
| 4,718,518 | 1/1988 | Brown | 182/165 X |
| 4,834,216 | 5/1989 | Wallick, Jr. et al. | 182/104 X |
| 5,098,052 | 3/1992 | Beck | 248/238 |
| 5,421,429 | 6/1995 | Evans | 182/111 |

FOREIGN PATENT DOCUMENTS

| | | |
|---|---|---|
| 642101 | 6/1962 | Canada . |
| A-401931 | 11/1933 | United Kingdom . |

*Primary Examiner*—Leslie A. Braun
*Assistant Examiner*—Long Dinh Phan
*Attorney, Agent, or Firm*—Goudreau Gage Dubuc & Martineau Walker

[57] ABSTRACT

A stepladder is provided with a bracing shelf that acts both as a conventional pivoting shelf and a bracing mechanism preventing accidental closing of the stepladder when the shelf is in a bracing position. The shelf includes abutting members adapted to contact a step of the stepladder, and, optionally, a mechanism to lock the shelf in the bracing position.

11 Claims, 4 Drawing Sheets

STEPLADDER INCLUDING A BRACING SHELF

FIELD OF THE INVENTION

The present invention relates to stepladders. More specifically, the present invention relates to a stepladder including a bracing shelf acting as a safety device to prevent accidental closing of the stepladder.

BRIEF DESCRIPTION OF THE PRIOR ART

Conventional stepladders consist of two sections, a load bearing section including a plurality of steps and a support section, both sections being hinged together at their upper end. The stepladder may take a closed position in which the two sections are generally parallel to each other, or an open position in which the two sections define an angle between them.

For practical reasons, conventional stepladders also include a bracing mechanism to maintain a predetermined angle between the load bearing section and the support section when the stepladder is in the open position. Indeed, a mechanism must be provided to stop the opening of the support section with respect to the load bearing section once the predetermined angle between these two sections is reached.

This bracing mechanism is usually formed of first and second elongate metallic plates pivotally joined to each other at one of their ends. The other end of the first elongated plate is pivotally mounted to one side of the load bearing section while the other end of the second elongated plate is pivotally mounted to one side of the support section. The angle defined by the stepladder when it is in an open position is therefore defined by the length of the elongated plates since the opening of the stepladder is stopped when the two elongated plates are colinear. Of course, each stepladder usually includes two bracing mechanisms, one mounted on each side of the stepladder.

A frequent drawback associated with the use of the aforementioned conventional bracing mechanism is an early deterioration of the bracing mechanism, which renders the stepladder impossible or unsafe to use.

Another drawback associated with the use of the conventional bracing mechanism is the annoyance factor associated with the use of such mechanism. Indeed, when one wishes to close a conventional stepladder, the two bracing mechanisms must be manually disengaged, which may be awkward since they are mounted on opposite sides of the stepladder. Furthermore, the upward motion required to disengage the conventional bracing mechanism may cause hands or fingers of some users to be pinched between the two pivoting elongated plates when disengaging the bracing mechanism.

Another feature of the conventional stepladder is a shelf which is usually pivotally mounted to the support section of the stepladder. This pivoting shelf is very convenient since it provides a place to put tools when using the stepladder. However, this shelf creates a safety hazard since a user may accidentally or intentionally use it as a step. In such cases, two treacherous things may happen: first, the pivoting shelf may break and cause the user to fall; secondly, the pivoting shelf may pivot on itself while the user tries to put its foot on it, once again causing him to fall.

OBJECTS OF THE INVENTION

An object of the present invention is therefore to provide an improved stepladder which overcomes the above drawbacks.

Another object of the invention is to provide a stepladder having a bracing shelf used for preventing the stepladder from closing when the bracing shelf is in a bracing position.

Yet another aspect of the invention is to provide a stepladder having a bracing shelf including a locking mechanism to prevent accidental closure of the bracing shelf.

SUMMARY OF THE INVENTION

More specifically, in accordance with the present invention, there is provided a stepladder comprising:

- a load bearing section including first and second spaced apart legs and a plurality of steps extending between the first and second legs; each step having a top surface for stepping thereon, an undersurface, a front edge and a rear edge;
- a support section hingedly connected to the load bearing section for pivotable movements about a first axis between (i) an open position in which the load bearing section and the support section define an angle, and (ii) a closed position in which the load bearing section and the support section are generally parallel;
- means for limiting the angle defined by the load bearing section and the support section when the support section is in the open position; and
- a bracing shelf pivotally mounted to the support section for pivotable movements about a second axis parallel to the first axis, between a bracing position and a retracted position; the bracing shelf having an inner projecting portion adapted to rest in interlocking engagement with of one of the plurality of steps when (a) the support section is in the open position and (b) the bracing shelf is in the bracing position; the interlocking engagement between the inner projecting portion and one of the steps of the load bearing section being such that it prevents the support section from pivoting to the closed position when the bracing shelf is in the bracing position.

Other objects, advantages and features of the present invention will become more apparent upon reading of the following non restrictive description of preferred embodiments thereof, given by way of example only with reference to the accompanying drawings.

DETAILED DESCRIPTION OF PREFERRED EMBODIMENTS

Figure 2:
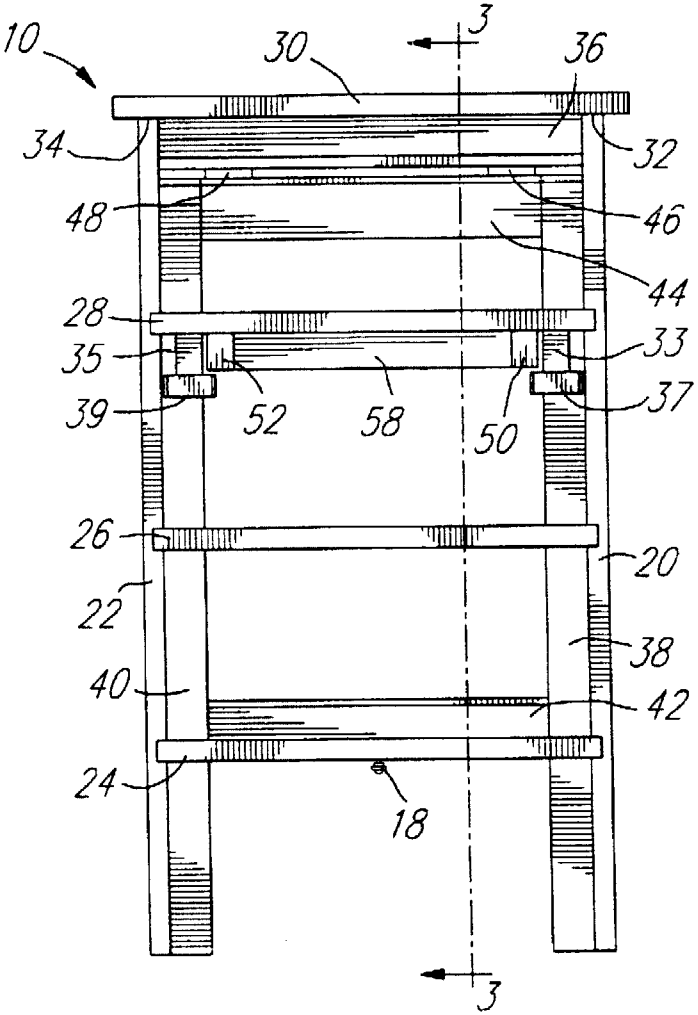
FIG. 2 is a front elevational view of the stepladder of FIG. 1.

Referring to FIGS. 1–4 of the appended drawings, a stepladder 10 according to a first embodiment of the present invention will be described.

The stepladder 10 consists of a load bearing section 12, a support section 14, a bracing shelf 16 and a chain 18.

The load bearing section 12 comprises first and second spaced apart legs 20, 22 and a plurality of intermediary steps 24, 26 and 28 mounted between the legs 20 and 22. A top step 30 is also mounted at respective upper ends 32, 34 of the first and second legs 20, 22. The load bearing section 12 also includes a transversal member 36 fixedly mounted to the top step 30 and to the first and second legs 20, 22. The purpose of the transversal member 36 will be explained hereinafter.

The stepladder 10 is illustrated in FIGS. 1–4 as having three steps 24, 26 and 28. However, a different number of steps could also be provided.

The step 28 includes an inner edge 29 and an undersurface 31. A pair of spacing blocks 33, 35 is fixedly mounted to the undersurface 31 of the step 28, and a pair of locking members 37, 39 is pivotally mounted to the spacing blocks 33, 35, respectively. The purpose of the spacing blocks 33, 35 and of the locking members 37, 39 will be explained hereinafter.

The support section 14 includes first and second spaced apart legs 38, 40, and first and second transversal members 42, 44, mounted between legs 38, 40.

Figure 1:
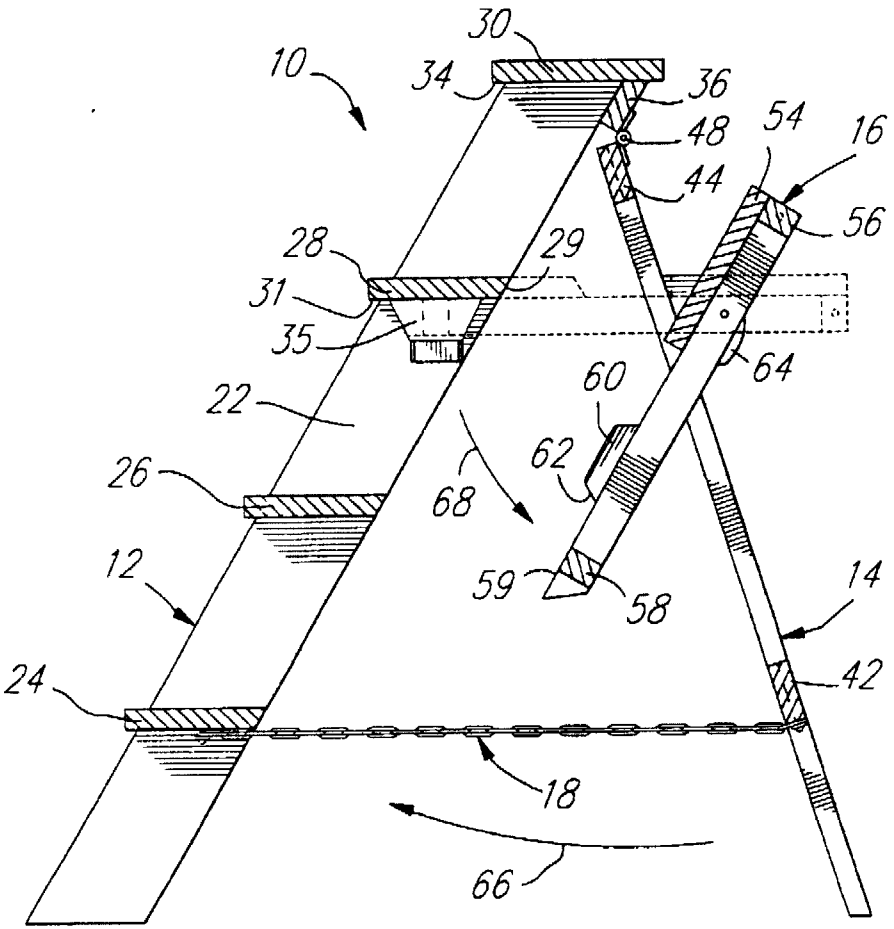
FIG. 1 is a side elevational sectional view of a stepladder according to a first embodiment of the present invention.
Figure 4:
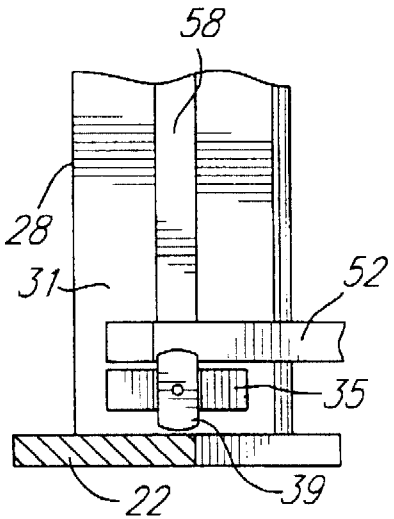
FIG. 4 is a sectional view taken along line 4—4 of FIG. 3.
Figure 3:
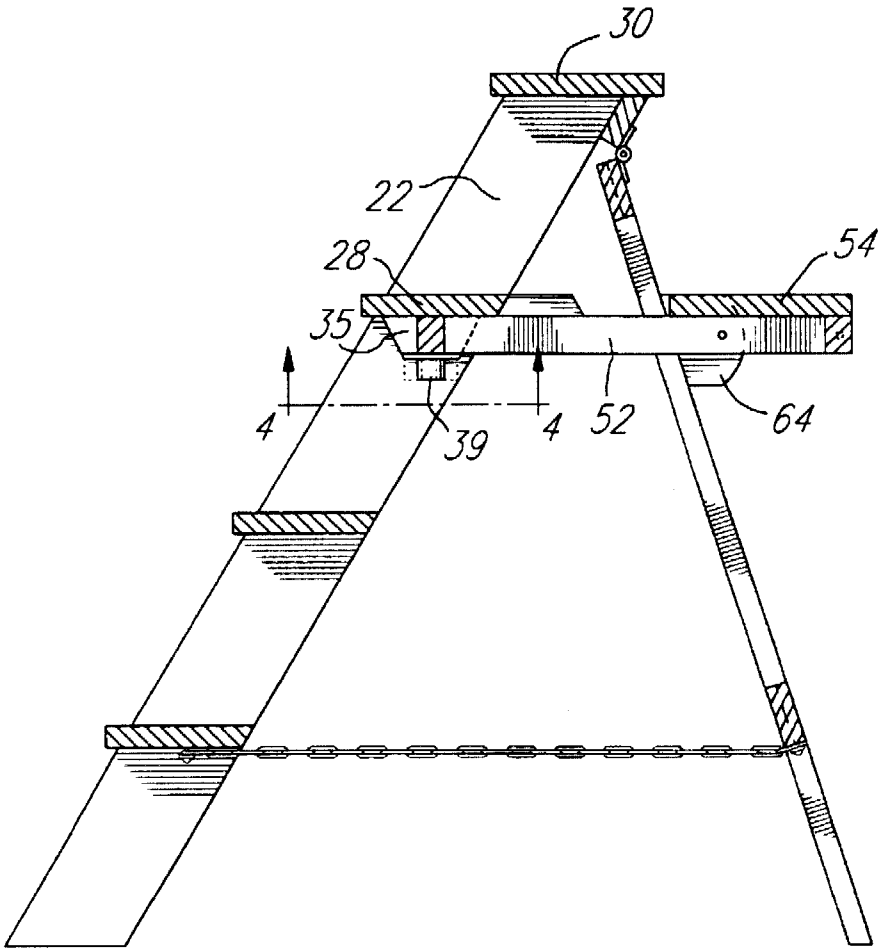
FIG. 3 is a side sectional view taken along line 3—3 of FIG. 2.

As shown in FIGS. 1 and 3, the support section 14 is hindgedly mounted to the load bearing section 12. A pair of hinges 46, 48 are mounted between the second transversal member 44 of the support section 14 and the transversal member 36 of the load bearing section 12. The support section 14 may therefore be alternatively positioned in an open position in which they define an angle (illustrated in FIG. 1) or in a closed position (not shown), in which the load bearing section 12 and the support section 14 are in a substantially parallel relationship.

The chain 18 is provided to limit the opening of the support section 14 when the stepladder 10 is in an open position. Indeed, the length of the chain 18 is such that a predetermined angle is defined by the load bearing section 12 and the support section 14 when the chain 18 is under tension. The chain 18 is mounted between the lower step 24 of the load bearing section 12 and the first transversal member 42 of the support section 14.

The bracing shelf 16 includes first and second spaced apart arms 50, 52, a shelf panel 54 and first and second transversal spacers 56, 58. Each arm 50, 52 includes a contacting surface 59 and an abutting member 60 (only one being shown) having an inner edge 62.

The first and second spacers 56, 58 are fixedly mounted between the first and second arms 50, 52, thereby determining the distance separating the first and second arms 50, 52. The shelf panel 54 is fixedly mounted over the first and second arms 50, 52. The bracing shelf 16 is pivotally mounted to the support section 14 through a pair of D-shaped brackets 64 (only one being shown). Each D-shaped bracket 64 is fixedly mounted to one of the legs 38, 40 of the support section 14. As illustrated, each arm 50, 52 of the bracing shelf 16 is pivotally mounted to one of the first and second legs 38, 40 of the support section 14.

The bracing shelf 16 may therefore be pivoted between a retracted position illustrated in full lines in FIG. 1 or a bracing position illustrated in dashed lines in FIG. 1 and in full lines in FIG. 3. When the bracing shelf 16 is in the bracing position, the contacting surface 59 of the arms 50, 52 are in contact with the undersurface 31 of the step 28.

In operation, when the bracing shelf 16 is in the position illustrated in dashed lines in FIG. 1, the inner edges 62 of the abutting pieces 60 are in contact with the inner edge 29 of the step 28. Therefore, when the bracing shelf 16 the position illustrated in dashed lines, it not possible to move the support section 14 the direction illustrated by arrow 66, e.g., to bring the support section 14 in a closed position, without first pivoting the bracing shelf 16 in the direction illustrated by arrow 68 since the contact of the inner edges 62 of the abutting pieces 60 and the inner edge 29 of step 28 prevents the pivoting, in the direction of arrows 66, of the support section 14 about hinges 46, 48.

Furthermore, when the bracing shelf 16 is in the position illustrated in dashed lines in FIG. 1, it is possible to pivotally engage the locking blocks 37, 39 so that a portion of each locking block 37, 39 lies over a portion of the arms 50, 52 of the bracing shelf 16. This position of the locking blocks 37, 39 is illustrated in FIGS. 3 and, in more details, in FIG. 4.

Therefore, when the stepladder 10 is in the position of FIG. 3, it is not possible to pivot the bracing shelf 16 in the direction of arrow 68 (see FIG. 1) without first rotating the locking blocks 37, 39 so that they do not lie over the arms 50, 52 of the bracing shelf 16.

As will be evident to one of ordinary skills in the art, if the material used to form the different sections of the stepladder 10 is sufficiently strong, the shelf panel 54 of the bracing shelf 16 may be used as a step without the drawbacks discussed above. As non limitative examples, the stepladder 10 could be made of wood, aluminium, plastic, synthetic resin, reinforced fibreglass, etc.

Figure 6:
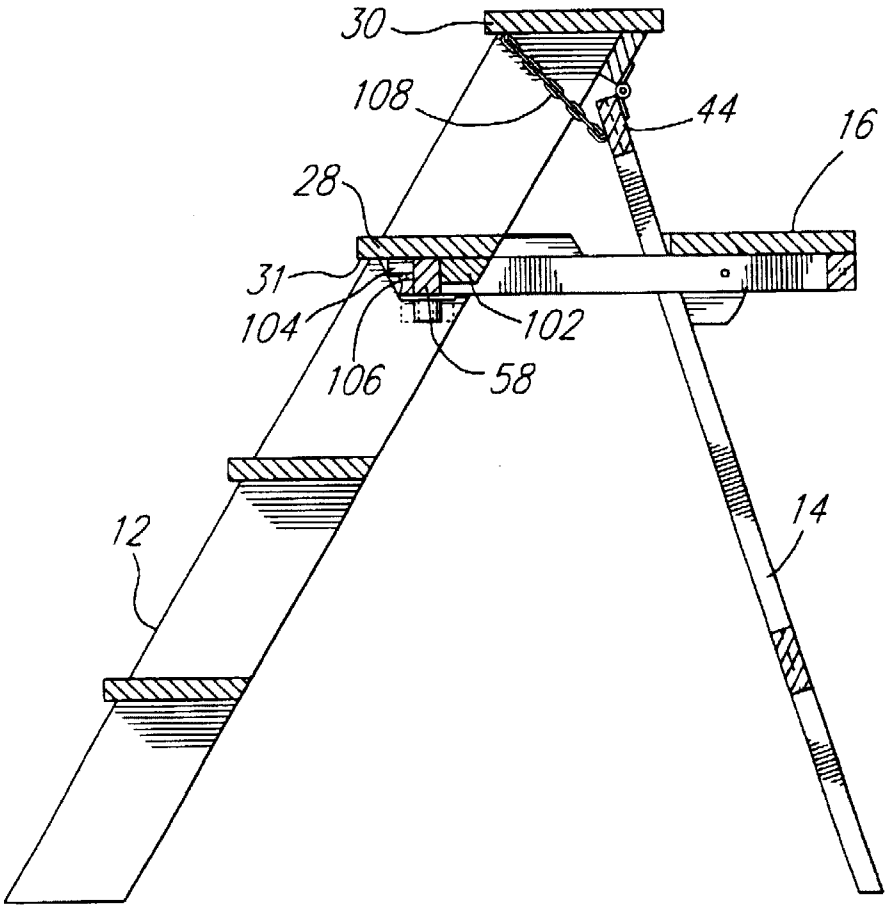
FIG. 6 is a sectional view taken along line 6—6 of FIG. 5.
Figure 5:
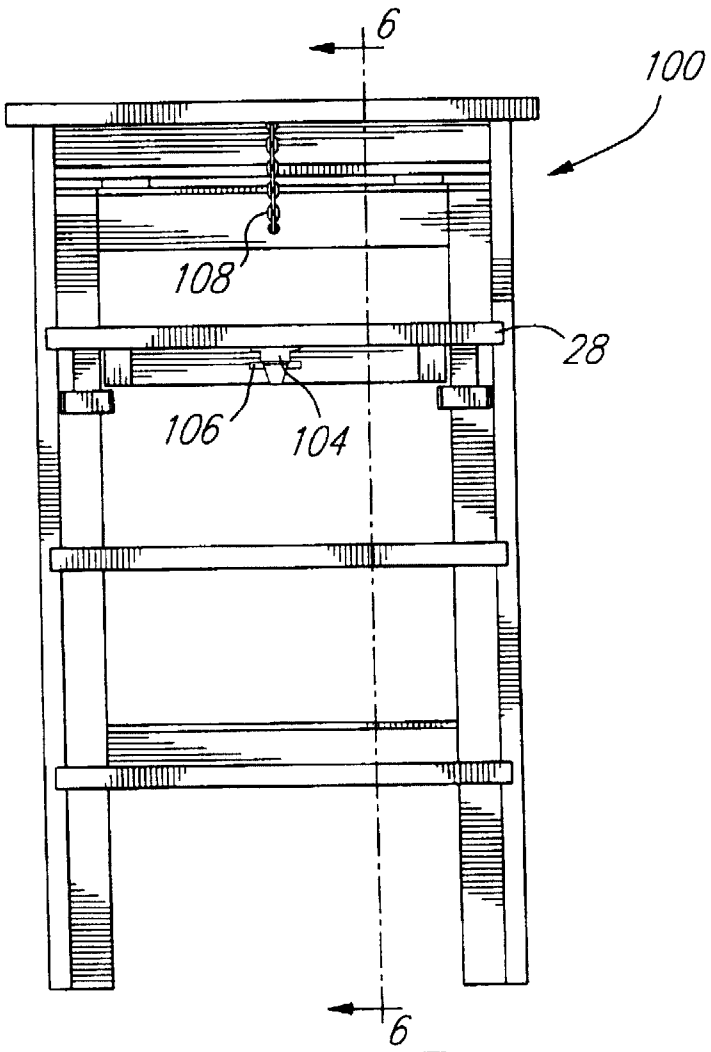
FIG. 5 is a front elevational view of a stepladder according to a second embodiment of the present invention.

Turning now to FIGS. 5–6, a stepladder 100, according to a second embodiment of the present invention, will be described.

Stepladder 100 is very similar to stepladder 10 illustrated in FIGS. 1 to 4. Accordingly, only the differences between stepladders 100 and 10 will be described hereinafter.

The chain 18 has been eliminated from stepladder 100. To limit the angle defined by the load bearing portion 12 and the support section 14, an abutting member 102 is fixedly mounted at a specific location to the undersurface 31 of the step 28. The abutting member 102 is mounted so as to be in contact with the spacing member 58 when the bracing shelf 16 is in the position of FIG. 6. The abutting member 102 therefore prevents further opening of the support section 14 with respect to the load bearing section 12. It is to be noted that this position of the abutting member 102 does not impede the pivotal movements of the bracing shelf 16 about the support section 14 as previously discussed.

A manual latching mechanism 104 is mounted to the undersurface 31 of the step 28. The latch mechanism 104 is adapted to latch to a block 106 mounted to the transversal spacer 58. The function of the latch mechanism 104 is similar to that of the locking members 37, 39 discussed hereinabove. One advantage of the latch mechanism 104 over the locking members 37, 39 is that it is automatically engaged when the bracing shelf 16 reaches the position illustrated in FIG. 6. Furthermore, the latch mechanism may be easily manually disengaged. It is to be noted that various latch mechanisms are commercially available and could be used as previously described.

A small chain 108 is mounted between the top step 30 and the second transversal member 44 of the support assembly 14. The chain 108 is provided only to help the user to position the support section in an appropriate angle before one attempts to pivot and latch the bracing shelf 16 in the bracing position illustrated in FIG. 6. The chain 108 is not used to limit the angle between the support section 14 and the load bearing section 12 while the stepladder 100 is used.

Figure 8:
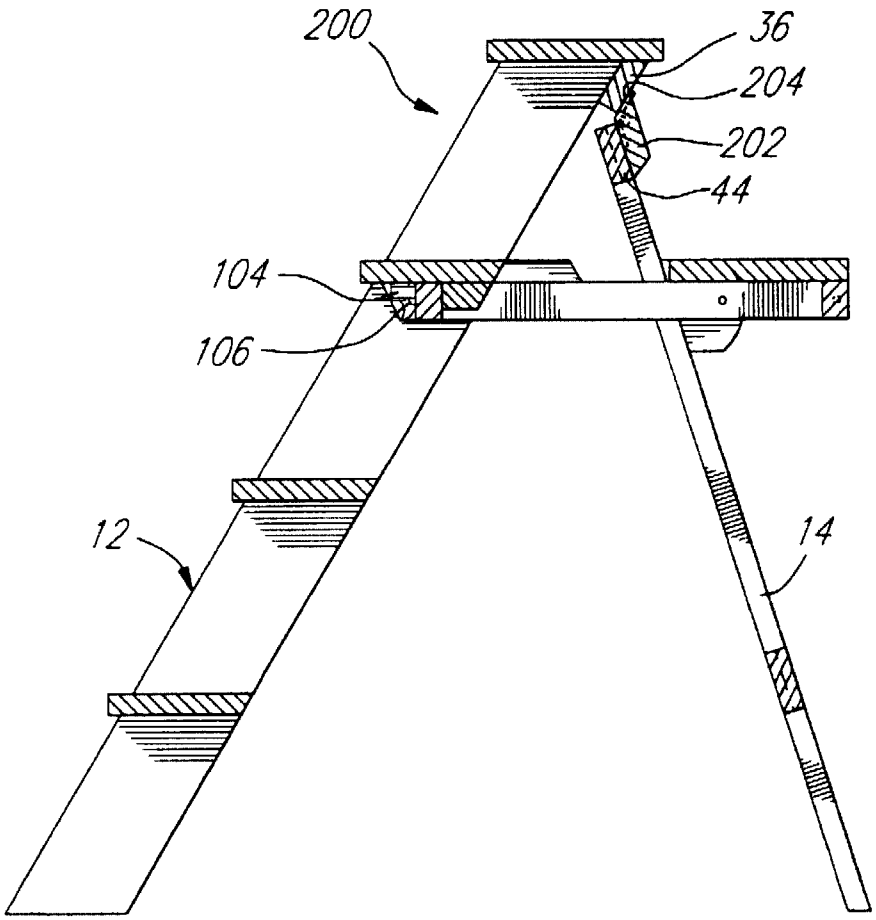
FIG. 8 is a sectional view taken along line 8—8 of FIG. 7.
Figure 7:
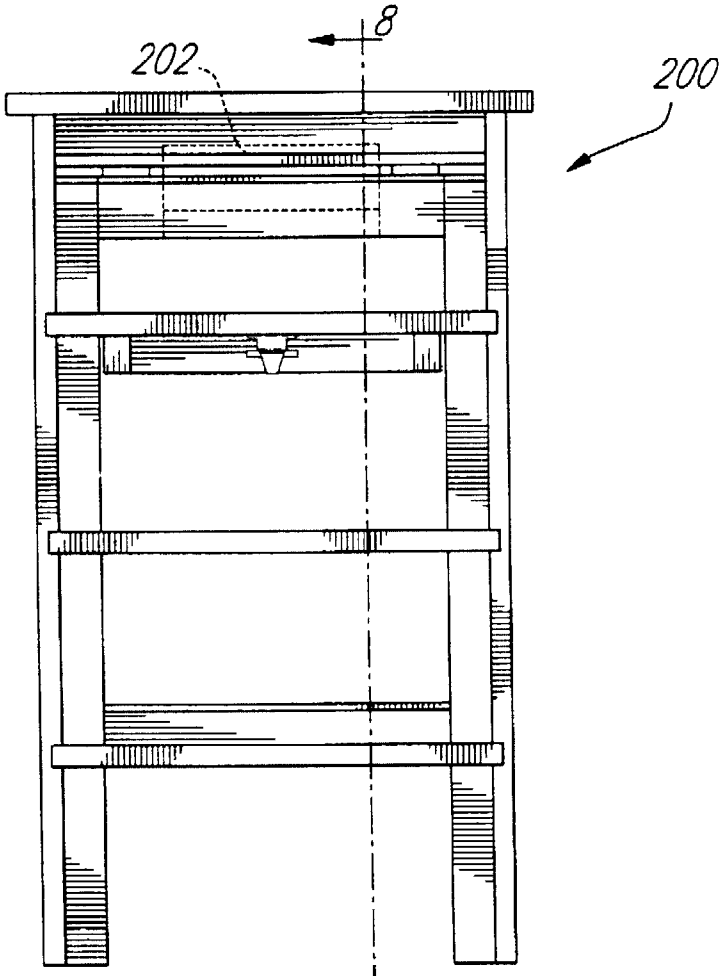
FIG. 7 is a front elevational view of a stepladder according to a third embodiment of the present invention.

Turning now to FIGS. 7–8, a stepladder 200, according to a third embodiment of the present invention, will be described.

Stepladder 200 is similar to stepladders 10 and 100 respectively illustrated in FIGS. 1 to 4 and FIGS. 5–6. Accordingly, only the differences between stepladder 200 and stepladders 10 and 100 will be described hereinafter.

While stepladder 100 include both the latch mechanism 104 and the locking members 37, 39, stepladder 200 only includes the latch mechanism 104 and the corresponding block 106. Indeed, it has been found that, if the latch mechanism 104 and the block 106 are solidly built (for example if they are made of solid metallic parts), the locking members 37, 39 are not required.

The small chain 108 of stepladder 100 has been replaced by an angled abutting block 202 fixedly mounted to the second transversal member of the support section 14. The abutting block 202 includes an angled edge 204 adapted to contact the transversal member 26 of the load bearing section 12 when the support section 14 reaches an appropriate angle with respect to the load bearing section 12. Again, block 202 is provided only to help the user to position the support section in an appropriate angle before one attempts to pivot and latch the bracing shelf 16 in the bracing position illustrated in FIG. 8. The block 202 is not used to limit the angle between the support section 14 and the load bearing section 12 while the stepladder 200 is used.

Although the present invention has been described hereinabove by way of preferred embodiments thereof, it can be modified at will, within the scope of the appended claims, without departing from the spirit and nature of the subject invention.

What is claimed is:

1. A stepladder comprising:

a load bearing section including first and second spaced apart legs and a plurality of steps extending between said first and second legs; each said step having a top surface for stepping thereon, an undersurface, a front edge and a rear edge; said load bearing section including a first interlocking means;

a support section hingedly connected to said load bearing section for pivotable movements about a first axis between (i) an open position in which said load bearing section and said support section define a predetermined angle, and (ii) a closed position in which said load bearing section and said support section are generally parallel;

a bracing shelf including an inner portion and being pivotally mounted to said support section for pivotable movements about a second axis parallel to said first axis, said bracing shelf being pivotable between a bracing position and a retracted position; said inner portion projecting generally towards said load bearing and being provided with second interlocking means adapted to rest in interlocking engagement with said first interlocking means when (a) said support section is in said open position, and (b) said bracing shelf is in said bracing position; said interlocking engagement between said first and second interlocking means being such that said support section is prevented from pivoting to said closed position and is prevented from exceeding said predetermined angle with respect to said load bearing section when said bracing shelf is in said bracing position;

wherein said first interlocking means are provided on one of said steps;

and said first interlocking further include a planar rear edge surface of said one of said steps, and wherein said second interlocking means including an abutting planar surface assembly so mounted to said inner projecting portion of said bracing shelf as to abutt said planar rear edge surface of said one of said steps to thereby prevent said support section from pivoting to said closed position when said bracing shelf is in said bracing position.

2. A stepladder as defined in claim 1, wherein said inner projecting portion comprised first and second spaced apart arms each having a top surface and an undersurface said abutting assembly including first and second abutting members respectively mounted to said top surface of said first and second spaced apart arms.

3. A stepladder as defined in claim 1, wherein said inner projecting portion comprises first and second spaced apart arms each having a top surface and an undersurface, and wherein (a) said first interlocking means include an abutting element mounted to the underside of one of said steps, and (b) said second interlocking means include a spacing member extending between said first and second spaced apart arms, whereby said spacing member and said abutting element are frictionally engaged when said bracing shelf is in said bracing position to prevent said support section from exceeding said predetermined angle with respect to said load bearing section.

4. A stepladder as defined in claim 1, wherein said inner projecting portion comprises first and second spaced apart arms each having a top surface and an undersurface, and wherein (a) said first interlocking means further include an abutting element mounted to the underside of one of said steps, and (b) said second interlocking means further include a spacing member extending between said first and second spaced apart arms, whereby said spacing member and said abutting element are frictionally engaged when said bracing shelf is in said bracing position to prevent said support section to exceed said predetermined angle with respect to said load bearing section.

5. A stepladder as defined in claim 1, wherein said bracing shelf further includes an outer portion generally projecting away from said load bearing portion; said outer portion an aditionnal step.

6. A stepladder as defined in claim 2, further comprising means for positively and releasably locking said bracing shelf in said bracing position.

7. A stepladder as defined in claim 8, wherein said means for positively and releasably locking said bracing shelf in said bracing position includes a locking mechanism for positively and releasably maintaining said first and second interlocking means in said interlocking engagement.

8. A stepladder as defined in claim 7, wherein said locking mechanism comprises:

at least one spacing block mounted to said undersurface of said one of said steps; said at least one spacing block having an undersurface;

at least one moveable locking element mounted to said undersurface of said at least one spacing block for movement between a locking position and a releasing position; said at least one moveable locking element having a contact surface for contacting said undersurface of one of said first and second spaced apart arms when (a) said first and second interlocking means are in said interlocking engagement, and (b) when said at least one spacing block is in said locking position, thereby preventing further pivoting of said bracing shelf.

9. A stepladder as defined in claim 7, wherein said locking mechanism comprises a manually releasable catch mounted to said undersurface of one of said steps; said manually releasable catch being adapted to contact said inner projecting portion of said bracing shelf to thereby positively and releasably maintain said inner projecting portion of said bracing shelf and said undersurface of said one of said steps in said interlocking engagement.

10. A stepladder as defined in claim 4, further comprising means for positively and releasably locking said bracing shelf in said bracing position.

11. A stepladder as defined in claim 10, wherein said means for positively and releasably locking said bracing shelf in said bracing position includes a locking mechanism for positively and releasably maintaining said first and second interlocking means in said interlocking engagement.

* * * * *